United States Patent [19]

Smith et al.

[11] Patent Number: 4,515,400

[45] Date of Patent: May 7, 1985

[54] WELLHEAD ASSEMBLY

[75] Inventors: Jerry D. Smith, Houston; Edward J. Szymczak, Spring, both of Tex.

[73] Assignee: Cameron Iron Works, Inc., Houston, Tex.

[21] Appl. No.: 358,445

[22] Filed: Mar. 15, 1982

[51] Int. Cl.[3] ..... F16L 7/00

[52] U.S. Cl. ..... 285/141; 285/142

[58] Field of Search ..... 285/140, 141, 142, 143, 285/144

[56] References Cited

U.S. PATENT DOCUMENTS

| | | | |
|---|---|---|---|
| 2,937,891 | 5/1960 | Gressel | 285/328 X |
| 3,114,566 | 12/1963 | Coberly et al. | 285/381 X |
| 3,367,002 | 2/1968 | Johnson | 285/144 X |
| 3,438,654 | 4/1969 | Jackson, Jr. et al. | 285/141 |
| 3,684,016 | 8/1972 | Hull et al. | 166/208 X |
| 4,056,272 | 11/1977 | Morrill | 285/140 |
| 4,295,665 | 10/1981 | Pierce | 285/141 X |
| 4,346,919 | 8/1982 | Morrill | 285/140 X |
| 4,455,040 | 6/1984 | Shinn | 285/142 |

FOREIGN PATENT DOCUMENTS

| | | | |
|---|---|---|---|
| 1340095 | 9/1963 | France | 285/142 |

*Primary Examiner*—Thomas F. Callaghan

*Attorney, Agent, or Firm*—Vinson & Elkins

[57] ABSTRACT

A wellhead assembly with an increased through bore for passing slightly oversized drill bits therethrough with a substantially reduced landing shoulder, and an improved landing assembly which transfers a portion of the stresses through the energizing ring and support ring into the wellhead body along the straight bore above said landing shoulder.

8 Claims, 3 Drawing Figures

PRIOR ART

WELLHEAD ASSEMBLY

BACKGROUND

In the drilling of oil and gas wells it is advantageous to be able to pass large diameter drill bits and bits which are slightly oversized through the landing shoulder bore of a wellhead member. While it might be suggested that boring out the wellhead member to pass such bits would be a solution to this problem it would reduce the strength of the member and its pressure rating. Reduction of the size of the landing shoulder alone would reduce the load carrying capacity of the landing shoulder.

One attempt to increase the through bore for the passage of large diameter bits and slightly oversized bits or various downhole pieces of equipment is disclosed in U.S. Pat. No. 3,684,016. Such patent suggests a split support ring that deflects radially outward into a groove in the wellhead hanger body. However, such construction, while possibly supplying adequate support has tendencies for the split ring to catch prematurely, or not all if the recess is filled with unexpected deposits.

Another example of a string hanging system is shown in U.S. Pat. No. 4,295,665. Such system includes a locking ring 60 which is a split ring spring biased to move outward and coacts with a shear pinned lock positioning element 97 which is a split spring biased inwardly. The element 97 includes grooves on its surface 110 to restrict the development of radial forces against the interior of the casing suspension collar 22 and also outer upwardly facing teeth 114 which are recited to engage the casing to transfer a portion of the weight into the outer collar 22. Such description set forth in such patent is believed to be contradictory in that one portion (grooves on surface 110) is to restrict the development of radial forces and the other (teeth 114) is to transfer radial forces to collar 22. Further upwardly directed teeth 114 will have a minimum of load bearing capacity as compared to downwardly directed teeth usually provided in hanger slips. Difficulties can develop if the locking ring recess is blocked by deposits or if it can possibly catch on joints or other grooves in the collar.

SUMMARY

The present invention relates to an improved wellhead assembly including a wellhead member with a bore therethrough and an upwardly facing internal shoulder, a hanger within the bore of the wellhead member, a support ring surrounding said hanger and having a downwardly and inwardly facing internal taper and an external gripping surface, said support ring adapted to seat on said wellhead shoulder, said hanger having an external downwardly and inwardly directed taper coacting with said support ring internal tapered surface when the support ring is on the wellhead shoulder to force said ring outward into gripping engagement with the interior of said wellhead member above the wellhead shoulder.

An object of the present invention is to provide an improved wellhead assembly with an internal landing shoulder sufficiently small to allow an oversized drill bit to pass therethrough without reducing the load supporting capacity or pressure rating of the wellhead assembly.

Another object is to provide an improved wellhead assembly which transfers a portion of the hanger load into the wall of the wellhead member above the landing shoulder.

A further object is to provide an improved wellhead assembly which assures landing on the landing shoulder without any problem of premature catching in grooves or recesses in the stack.

BRIEF DESCRIPTION OF THE DRAWINGS

These and other objects and advantages of the present invention are hereinafter set forth with respect to the drawings wherein.

DESCRIPTION OF THE PREFERRED EMBODIMENT

Figure 1:
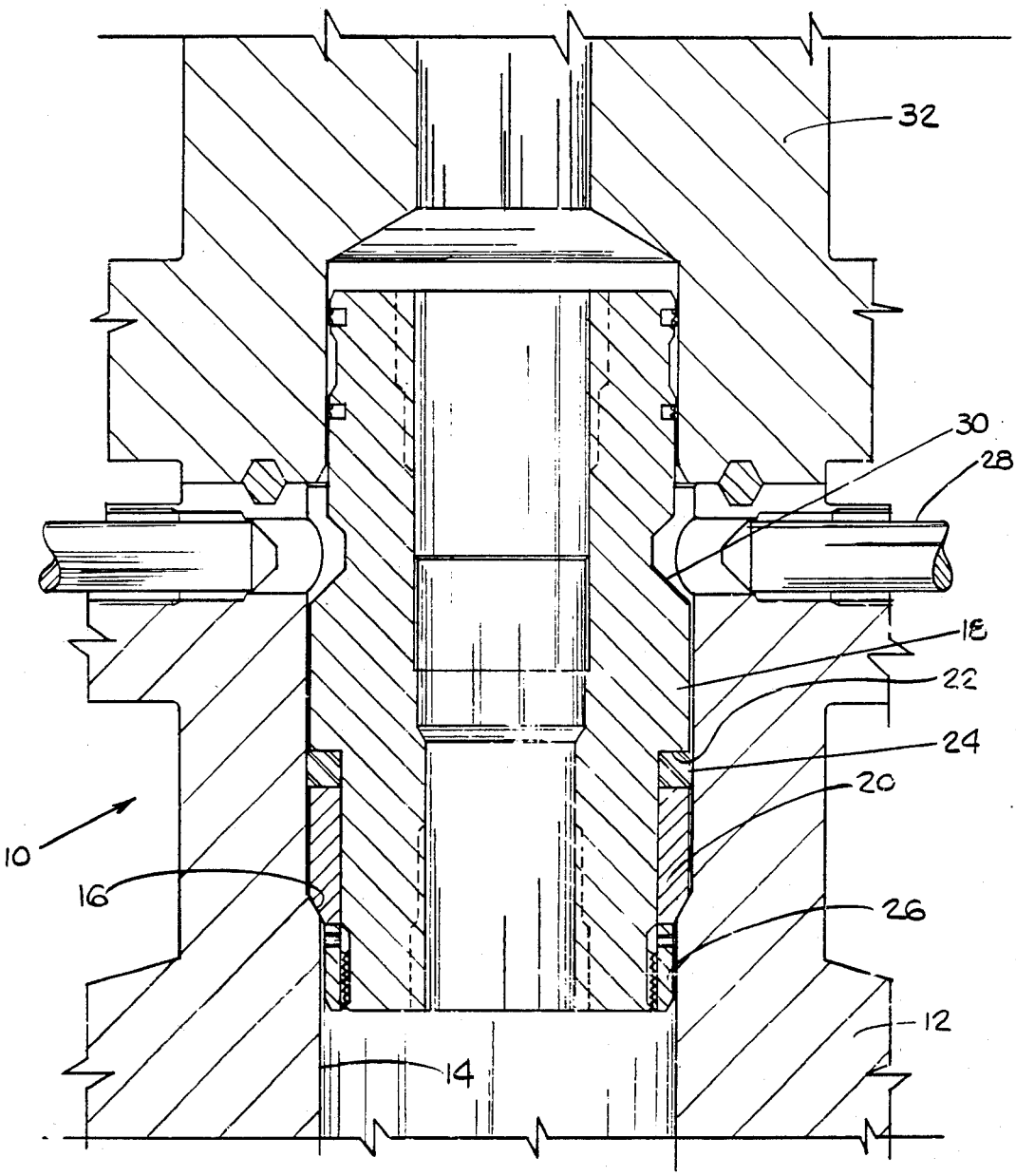
FIG. 1 is a vertical sectional view of a wellhead assembly of the prior art.

Wellhead assembly 10 of the prior art as shown in FIG. 1 includes wellhead member 12 having bore 14 therethrough with landing shoulder 16 facing upwardly and inwardly and hanger 18 with support ring 20 seated on landing shoulder 16 in supporting relationship to hanger 18. Hanger 18 has downwardly facing shoulder 22 with seal ring 24 positioned between shoulder 22 and the upper end of support ring 20. Nut 26 is threaded onto the lower exterior of hanger 18. Hold down screws 28 thread through wellhead member 12 and engage with the lower portion of groove 30 in the exterior of hanger 18 to ensure that hanger 18 remains in landed position. Seal flange 32 is suitably secured to the upper end of wellhead member 12.

In such prior art structure, the diameter of wellhead member 12 below landing shoulder 16 is preselected to permit passage of the largest size of drill bit expected to be used. However, when a drill bit is slightly oversized, it will not pass through wellhead member 12. If the bore 14 is enlarged above and below shoulder 16, the pressure rating of wellhead member is reduced and if it is enlarged only below shoulder 16, the load carrying capacity of landing shoulder 16 is reduced.

Figure 2:
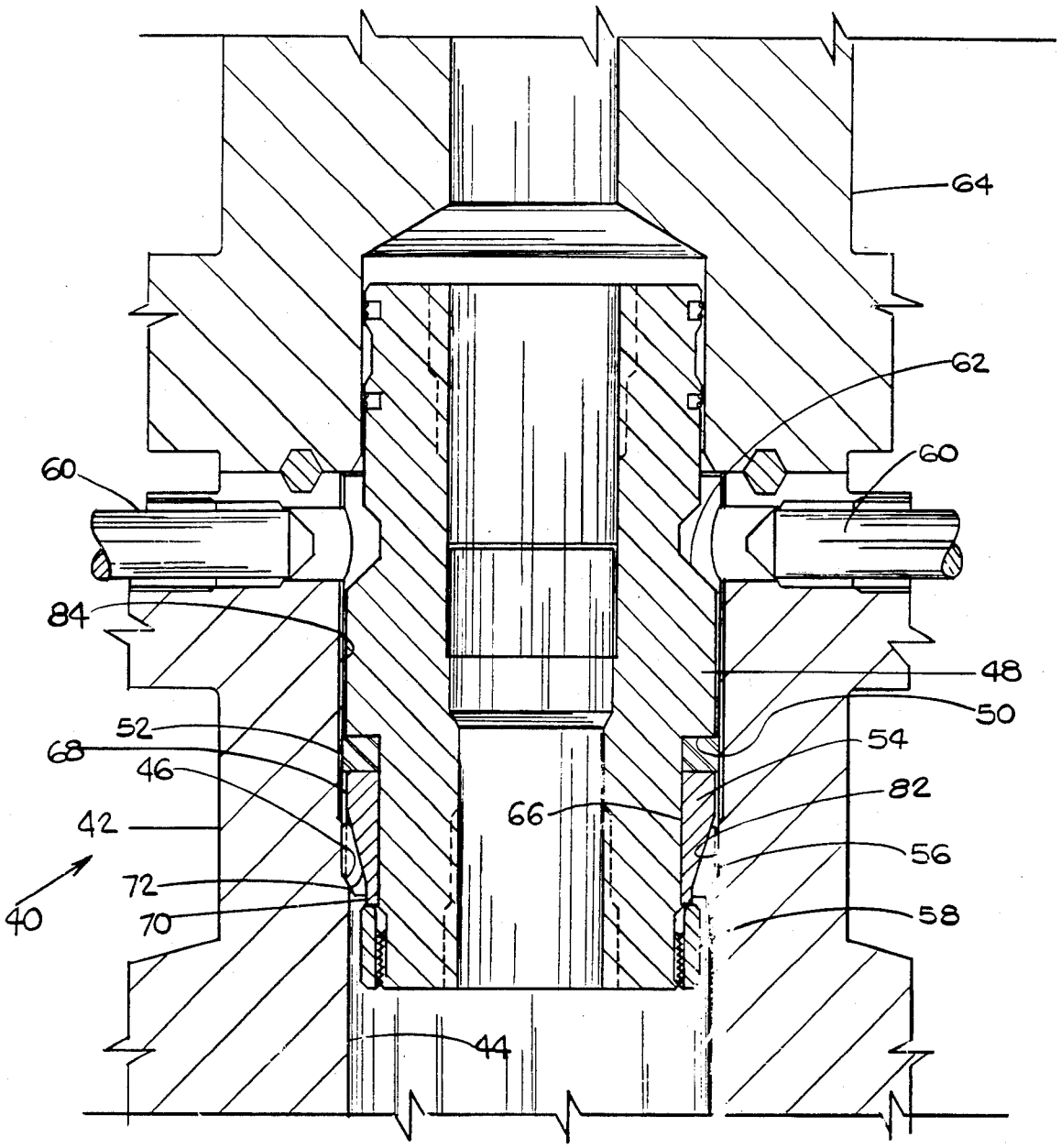
FIG. 2 is a vertical sectional view of the improved wellhead assembly of the present invention.
Figure 3:
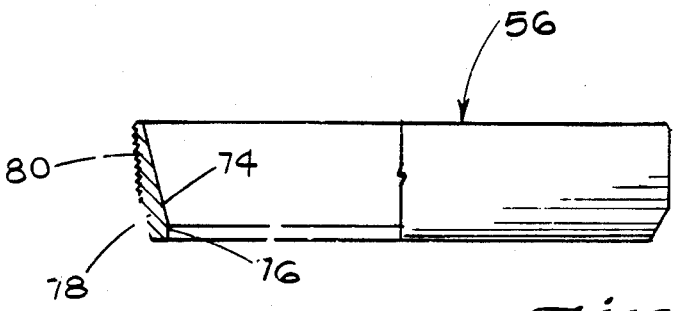
FIG. 3 is an elevation view, partly in section, of the improved support ring of the present invention.

The foregoing problem is solved by the improved wellhead assembly 40 shown in FIG. 2. Wellhead assembly 40 includes wellhead member 42 having bore 44 therethrough with landing shoulder 46 therein and hanger 48 which is supported within wellhead member 42 as hereinafter described. In an assembly of the same size and pressure rating, the inner diameter of member 42 below shoulder 46 is larger than the inner diameter of member 12 below shoulder 16 shown in FIG. 1. Hanger 48 includes downwardly facing shoulder 50, seal ring 52, energizing ring 54, with seal ring 52 positioned between shoulder 50 and the upper end of energizing ring 54, support ring 56 which engages landing shoulder 46 and the bore above shoulder 46 and ring 54 and retainer nut 58 threaded onto the lower exterior of hanger 48 as shown. Hold down screws 60 thread through member 42 and are adapted to engage the lower portion of groove 62 to retain hanger 48 in seated position within member 42. Seal flange 64 is suitably secured to the upper end of wellhead member 42.

Since landing shoulder 46 is smaller it will not support as much load as it would if it were larger. In order that the laod capacity of the improved wellhead assembly 40 of the present invention is not sacrificed to the larger bore 44, energizing ring 54, support ring 56, hanger 48 and the interior of wellhead member 42 coact to provide such incremental load capacity as hereinafter explained. Energizing ring 54 has an inner surface 66 which is parallel to and slightly larger than the diameter of the hanger surface around which ring 54 is positioned. The exterior of ring 54 includes upper cylindrical surface 68, lower cylindrical surface 70 and tapered surface 72 therebetween. Surface 72 tapers downwardly and inwardly at an angle substantially less than 45° and preferably between 15° to 23° and urges support ring 56 outwardly into a position for engaging member 42.

Support ring 56 has inner surface 74 which has the mating taper to surface 72 of ring 54 and ends in inner cylindrical surface 76, seating surface 78 and exterior grooved surface 80. Seating surface 78 is tapered downward and inwardly at the same angle as landing shoulder 46 for seating thereon. Grooved surface 80 is preferably serrated with "phonograph" grooves, such as a 1/32 inch pitch thread, however, such grooves may have downwardly facing teeth.

The interior surface 82 of wellhead member 42 above landing shoulder 46 is substantially the same diameter as the exterior of support ring 56 with only sufficient clearance so that expansion of support ring 56 into gripping engagement does not expand it beyond its elastic limit. For example, normally a tolerance of 0.015 inches per inch of diameter would be allowed but with the present invention a tolerance of only 0.005 inches per inch of diameter is used to ensure that ring 56 is not expanded beyond its elastic limit. Also, support ring 56 is preferably made of a 414 stainless steel. Inner surface 84 of wellhead member 42 above surface 82 is of a larger diameter so that ring 56 moves readily therethrough.

When hanger 48 has been lowered to the position shown in FIG. 2, the weight of hanger 48 and the string (not shown) which it supports is exerted by shoulder 50, through seal ring 52 to energizing ring 54. The load is transferred to support ring 56 through the tapered surfaces 72 and 74. This expands ring 56 into tight engagement with surface 82 so that a portion of the load is transferred to and carried by surface 82. The expansion of ring 56 is maintained within its elastic limit so that on relieving of the load and the upward movement of energizing ring 54 by the engagement of nut 58, ring 56 contracts to its original shape and can be moved out of wellhead member 42. Since ring 56 is not permanently deformed in expanding into supporting engagement with surface 82, it may be left on hanger 48 and reused during further running operations.

What is claimed is:

1. A wellhead assembly comprising a wellhead member having a central bore therethrough and an internal shoulder tapered upwardly and outwardly, a wellhead hanger within the central bore of said wellhead member and having a downwardly facing external shoulder and means for supporting a tubular string from the lower end of said hanger, an energizing ring surrounding said hanger below said shoulder and having an external downwardly and inwardly extending tapered surface, a support ring seated on said wellhead member shoulder and having an external vertical surface with phonographic grooves therein and an internal downwardly and inwardly extending tapered surface substantially mating with said external tapered surface on said energizing ring, the tapered surfaces on said energizing ring and said support ring having an angle substantially less than 45° with respect to vertical, the lower end of said energizing ring extending below said support ring when they are in supporting engagement between said hanger and said wellhead member, and means on the lower exterior surface of said hanger for engaging and supporting said rings thereon during running and pulling of said hanger, the tapered surfaces of said rings coacting when supporting said hanger to transfer at least a portion of the hanger load through said support ring vertical grooved surface to the surface of the bore of said wellhead member above its internal shoulder.

2. A wellhead assembly according to claim 1 wherein said support ring in its unenergized position fits closely adjacent said wellhead member interior whereby energizing said support ring does not exceed its elastic limit.

3. A wellhead assembly according to claim 1 wherein the angle of said tapered surface with respect to the axis of said central bore is between 15° to 21°.

4. A wellhead assembly according to claim 1 wherein said support ring is a solid ring.

5. A wellhead assembly according to claim 1 wherein said shoulder on said wellhead member is small to provide an increased through bore.

6. A wellhead assembly according to claim 1 wherein vertical stresses are transferred through the tapered surfaces of the energizing ring and support ring into horizontal stresses transmitted to said wellhead member.

7. A wellhead assembly according to claim 1 whereby said energizing ring and support ring are wedged tightly so that wellhead hanger loads are supported on the straight bore of said wellhead member in the area contacted by the support ring.

8. A wellhead assembly according to claim 1 including a seal ring positioned between said wellhead member and said wellhead hanger and on the top of said energizing ring and said downwardly facing shoulder on said hanger, the landing of said hanger on said wellhead member compressing said seal ring between said downwardly facing shoulder and said energizing ring.

* * * * *